US012798040B2

(12) United States Patent
Miura et al.

(10) Patent No.: US 12,798,040 B2
(45) Date of Patent: Nov. 17, 2026

(54) POLISHING APPARATUS

(71) Applicant: EBARA CORPORATION, Tokyo (JP)

(72) Inventors: Shumpei Miura, Tokyo (JP); Kenichi Suzuki, Tokyo (JP); Itsuki Kobata, Tokyo (JP); Yasuyuki Motoshima, Tokyo (JP); Ban Ito, Tokyo (JP); Seungho Yun, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 508 days.

(21) Appl. No.: 18/352,325

(22) Filed: Jul. 14, 2023

(65) Prior Publication Data

US 2024/0033876 A1 Feb. 1, 2024

(30) Foreign Application Priority Data

Jul. 27, 2022 (JP) ..... 2022-119243

(51) Int. Cl.
*B24B 37/015* (2012.01)
*B24B 37/34* (2012.01)

(52) U.S. Cl.
CPC ..... *B24B 37/015* (2013.01); *B24B 37/34* (2013.01)

(58) Field of Classification Search
CPC ..... B24B 7/228; B24B 37/015; B24B 37/34; B24B 37/10–107; B24B 53/012; B24B 53/02; B24B 53/095; B24B 49/14; B24B 55/02; B24B 57/02; B08B 2203/007; B08B 3/10; H01L 21/30625
USPC ..... 451/7, 41, 36, 37, 56, 60, 287, 443
See application file for complete search history.

(56) References Cited

U.S. PATENT DOCUMENTS 11,633,833 B2 * 4/2023 Wu ..... B24B 53/005 451/56
2006/0105678 A1 * 5/2006 Kohama ..... B24B 57/02 451/5
2020/0001426 A1 * 1/2020 Soundararajan ..... B24B 37/015
2021/0402552 A1 * 12/2021 Kumar ..... B24B 49/12
2022/0118582 A1 4/2022 Hong et al.

FOREIGN PATENT DOCUMENTS

JP 2003-142431 A 5/2003
JP 2003-145064 A 5/2003
JP 2004-042217 A 2/2004
(Continued)

*Primary Examiner* — Robert F Neibaur
(74) *Attorney, Agent, or Firm* — Chrisman Gallo Tochtrop LLC

(57) ABSTRACT

A polishing apparatus is disclosed, which is capable of heating and maintaining a temperature distribution of a polishing pad at a predetermined temperature distribution with a simple structure. The polishing apparatus has a pad-temperature regulating apparatus for regulating a temperature of a polishing surface, and the pad-temperature regulating apparatus includes a heating-fluid nozzle arranged above and spaced apart from the polishing surface. The heating-fluid nozzle includes: a nozzle body; a slit formed along a longitudinal direction of the nozzle body for ejecting a heating fluid toward the polishing surface; a header tube which is formed within the nozzle body and into which the heating fluid is supplied; a buffer tube which is formed within the nozzle body and communicates with the slit, and a plurality of branch tubes for coupling the header tube to the buffer tube.

8 Claims, 11 Drawing Sheets

(56) References Cited

FOREIGN PATENT DOCUMENTS

| | | | |
|---|---|---|---|
| JP | 2012-148376 | A | 8/2012 |
| JP | 5547472 | B2 | 7/2014 |
| JP | 2017-148933 | A | 8/2017 |
| JP | 6353266 | B2 | 7/2018 |
| JP | 2020-109839 | A | 7/2020 |
| JP | 2022-520834 | A | 4/2022 |
| JP | 2022-528798 | A | 6/2022 |
| WO | 2020/005749 | A1 | 1/2020 |
| WO | 2020/172215 | A1 | 8/2020 |

* cited by examiner

POLISHING APPARATUS

CROSS REFERENCE TO RELATED APPLICATION

This document claims priority to Japanese Patent Application No. 2022-119243 filed Jul. 27, 2022, the entire contents of which are hereby incorporated by reference.

BACKGROUND

CMP (Chemical Mechanical Polishing) apparatus is used in a process of polishing a surface of a substrate in a semiconductor device fabrication. The CMP apparatus is configured to hold and rotate the substrate with a polishing head, and press the substrate against a polishing pad on a rotating polishing table to polish the surface of the substrate. During polishing, a polishing liquid (e.g., slurry) is supplied onto the polishing pad, so that the surface of the substrate is planarized by the chemical action of the polishing liquid and the mechanical action of abrasive particles contained in the polishing liquid.

A polishing rate of substrate depends not only on a polishing load on the substrate pressed against the polishing pad, but also on a surface temperature of the polishing pad. From this viewpoint, a pad-temperature regulating apparatus has been conventionally used to regulate the surface temperature of the polishing pad. For example, a polishing apparatus described in Japanese laid-open patent publication No. 2017-148933 has a pad-temperature regulating apparatus including a pad contact member which contacts the surface of the polishing pad, and into which a heating liquid having a regulated temperature and a cooling liquid having a regulated temperature are supplied. Japanese Patent No. 5628067 describes that a fluid, such as dry gas, is blown onto the polishing pad from a nozzle placed above the polishing pad to thereby maintain a temperature distribution in a radial direction of the polishing pad at a predetermined temperature distribution.

In the case where the pad-temperature regulating apparatus has a pad contact member, the temperature of the polishing pad can be directly regulated, thereby making it facilitated to maintain the polishing pad at the predetermined temperature distribution. On the other hand, the pad contact member is inevitably in contact with the polishing liquid during polishing of the substrate, and thus dirt, such as abrasive grains contained in the polishing liquid, and wear particles of the polishing pad, adhere to the pad contact member. When dirt falls off from the pad contact member onto the substrate during polishing thereof, the substrate can be contaminated, and defects, such as scratches, can be caused on the substrate.

In the case of the pad-temperature regulating apparatus in which a fluid (e.g., heating fluid) is blown onto the polishing pad, it becomes difficult to heat and maintain the temperature distribution of the polishing pad at the predetermined temperature distribution if an amount of heating fluid blown onto the polishing pad is uneven. Therefore, the pad-temperature regulating apparatus needs to have a mechanism for correcting the unevenness in the amount of heating fluid in the radial direction of the polishing pad. In this case, the pad-temperature regulating apparatus may become more complicated, and further may become more expensive.

SUMMARY

Accordingly, there is provided a polishing apparatus capable of heating and maintaining a temperature distribution of the polishing pad at a predetermined temperature distribution with a simple structure.

Embodiments, which will be described below, relate to a polishing apparatus for polishing a substrate, such as a semiconductor wafer, by bringing the substrate into sliding contact with a polishing pad, and more particularly to a polishing apparatus for polishing a substrate while regulating a temperature of a surface of the polishing pad.

In an embodiment, there is provided a polishing apparatus for polishing a substrate by pressing the substrate held by a polishing head against a polishing surface of a polishing pad supported by a polishing table, comprising: a pad-temperature regulating apparatus configured to regulate a temperature of the polishing surface based on a measurement value of a pad-temperature measuring device for measuring the temperature of the polishing surface, wherein the pad-temperature regulating apparatus includes a heating-fluid nozzle arranged above and spaced apart from the polishing surface; and wherein the heating-fluid nozzle includes: an elongate nozzle body; at least one slit formed along a longitudinal direction of the nozzle body for ejecting a heating fluid toward the polishing surface; a header tube which is formed within the nozzle body and into which the heating fluid is supplied; a buffer tube which is formed within the nozzle body and communicates with the slit, and a plurality of branch tubes for coupling the header tube to the buffer tube.

In an embodiment, the at least one slit extends to an end surface of a tip of the nozzle body.

In an embodiment, the buffer tube and the header tube extend along the longitudinal direction of the nozzle body.

In an embodiment, the nozzle body extends in an approximate radial direction of the polishing pad.

In an embodiment, the nozzle body is made of or coated with a material having chemical resistance and/or heat insulation.

In an embodiment, the polishing apparatus further comprises a cleaning apparatus configured to clean the heating-fluid nozzle at a retreat-position located laterally to the polishing pad.

According to the above embodiments, a simple structure, in which the header tube, the buffer tube, and the plurality of branch tubes are provided in the heating fluid nozzle, enables the pressure distribution of the heating fluid in the buffer tube to be made even, and further improves a flow guiding of the heating fluid ejected from the slit. As a result, an amount of heating fluid ejected from the slit can be made even, thereby heating and maintaining the temperature distribution in the polishing surface of the polishing pad at a predetermined temperature distribution.

DESCRIPTION OF EMBODIMENTS

Hereinafter, embodiments will be described with reference to the drawings.

Figure 1:
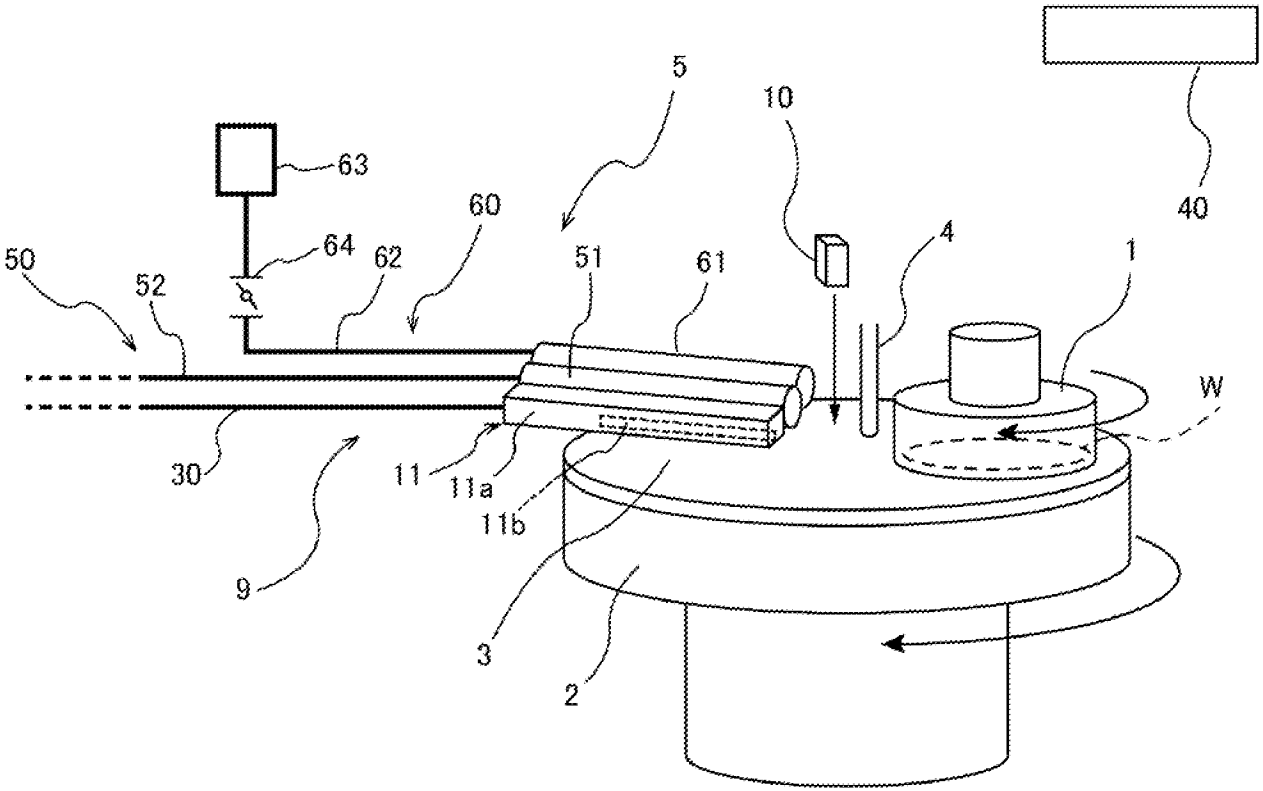
FIG. 1 is a schematic view showing a polishing apparatus according to an embodiment.

FIG. 1 is a schematic view showing a polishing apparatus according to an embodiment. The polishing apparatus shown in FIG. 1 includes a polishing head 1 for holding and rotating a wafer W which is an example of a substrate, a polishing table 2 that supports a polishing pad 3, a polishing-liquid supply nozzle 4 for supplying a polishing liquid (e.g. a slurry) onto a surface of the polishing pad 3, a pad-temperature measuring device 10 for measuring a temperature of a surface of the polishing pad 3, and a pad-temperature regulating apparatus 5 for regulating the temperature of the surface of the polishing pad 3. The surface (upper surface) of the polishing pad 3 provides a polishing surface for polishing the wafer W.

Further, the polishing apparatus has a controller 40 configured to control operation of the pad-temperature regulating apparatus 5 based on the temperature of the polishing surface of the polishing pad 3 (hereinafter may be referred to as "pad surface temperature") measured by the pad-temperature measuring device 10. In this embodiment, the controller 40 is configured to control operation of the polishing apparatus in its entirety, including the pad-temperature regulating apparatus 5.

The polishing head 1 is vertically movable, and is rotatable about its axis in a direction indicated by arrow. The wafer W is held on a lower surface of the polishing head 1 by, for example, vacuum suction. A motor (not shown) is coupled to the polishing table 2, so that the polishing table 2 can rotate in a direction indicated by arrow. As shown in FIG. 1, the polishing head 1 and the polishing table 2 rotate in the same direction. The polishing pad 3 is attached to an upper surface of the polishing table 2.

Polishing of the wafer W is performed in the following manner. The wafer W, to be polished, is held by the polishing head 1, and is then rotated by the polishing head 1. The polishing pad 3 is rotated together with the polishing table 2. In this state, the polishing liquid is supplied from the polishing-liquid supply nozzle 4 onto the surface of the polishing pad 3, and the surface of the wafer W is then pressed by the polishing head 1 against the surface (i.e. polishing surface) of the polishing pad 3. The surface of the wafer W is polished by the sliding contact with the polishing pad 3 in the presence of the polishing liquid. The surface of the wafer W is planarized by the chemical action of the polishing liquid and the mechanical action of abrasive grains contained in the polishing liquid.

The pad-temperature regulating apparatus 5 has a heating mechanism 9 for heating the polishing surface of the polishing pad 3. This heating mechanism 9 includes at least a heating-fluid nozzle 11 that serves as a pad heater arranged above the polishing pad 3, and a heating-fluid supply system 30 for supplying a heating fluid to the heating-fluid nozzle 11. The heating fluid supplied to the heating-fluid nozzle 11 through the heating-fluid supply system 30 is ejected onto the polishing surface of the polishing pad 3 to thereby heat the polishing surface to a predetermined target temperature and maintain the polishing surface at this target temperature.

Further, the pad-temperature regulating apparatus 5 shown in FIG. 1 has a cooling mechanism 50 that ejects a fluid onto the polishing surface of the polishing pad 3 in order to cool the polishing surface, and a suction mechanism 60 arranged above the polishing surface of the polishing pad 3.

The cooling mechanism 50 has at least a pad cooler 51 arranged above the polishing pad 3, and a cooling-fluid supply system 52 for supplying a cooling fluid to the pad cooler 51. The suction mechanism 60 has at least a suction nozzle 61 arranged above the polishing pad 3, a vacuum source (vacuum apparatus) 63, and a suction line 62 coupling the vacuum source 63 to the suction nozzle 61. Examples of the vacuum source 63 may include a suction pump, a suction fan, and an ejector. The suction mechanism 60 may have a flow regulator 64 disposed in the suction line 62. The flow regulator 64 is, for example, a damper.

In this embodiment, the pad-temperature measuring device 10 is configured to measure the pad surface temperature in a non-contact manner, and to send measurement value to the controller 40. The pad-temperature measuring device 10 may be an infrared radiation thermometer or a thermocouple thermometer which measures the surface temperature of the polishing pad 3, or may be a temperature-distribution measuring device which acquires a temperature distribution (temperature profile) of the polishing pad 3 along a radial direction of the polishing pad 3. Examples of the temperature-distribution measuring device may include a thermography, a thermopile, and an infrared camera. In the case where the pad-temperature measuring device 39 is the temperature-distribution measuring device, the pad-temperature measuring device 39 is configured to measure a distribution of the surface temperature of the polishing pad 3 in an area including a center and a peripheral portion of the polishing pad 3 and extending in a radial direction of the polishing pad 3. In this specification, the temperature distribution (temperature profile) indicates a relationship between the pad surface temperature and the radial position on the wafer W.

The controller 40 is configured to control operation of the pad-temperature regulating apparatus 5 based on the pad surface temperature measured such that the pad surface temperature is maintained at a predetermined target temperature (or temperature distribution). Hereinafter, an embodiment will be described, in which the heating fluid supplied from the heating fluid supply system 30 to the heating fluid nozzles 11 is superheated steam. However, the heating fluid is not limited to this embodiment. The heating fluid may be a high-temperature gas (e.g., high-temperature air, nitrogen, or argon), or a heated steam. The term "superheated steam" refers to high-temperature steam that is further heated from saturated steam.

Further, in the following, an embodiment will be described, in which the cooling fluid is a gas (e.g., an inert gas, such as nitrogen and argon) at ambient temperature. However, the cooling fluid is not limited to this embodiment. The cooling fluid may be a gas cooled to a set temperature lower than ambient temperature, or a gas heated from ambient temperature to a set temperature lower than the target temperature of the polishing pad 3. The cooling fluid is preferably an inert gas, taking into account its effect on the polishing liquid. However, the cooling fluid may be a different gas from the inert gas, such as air.

Figure 2:
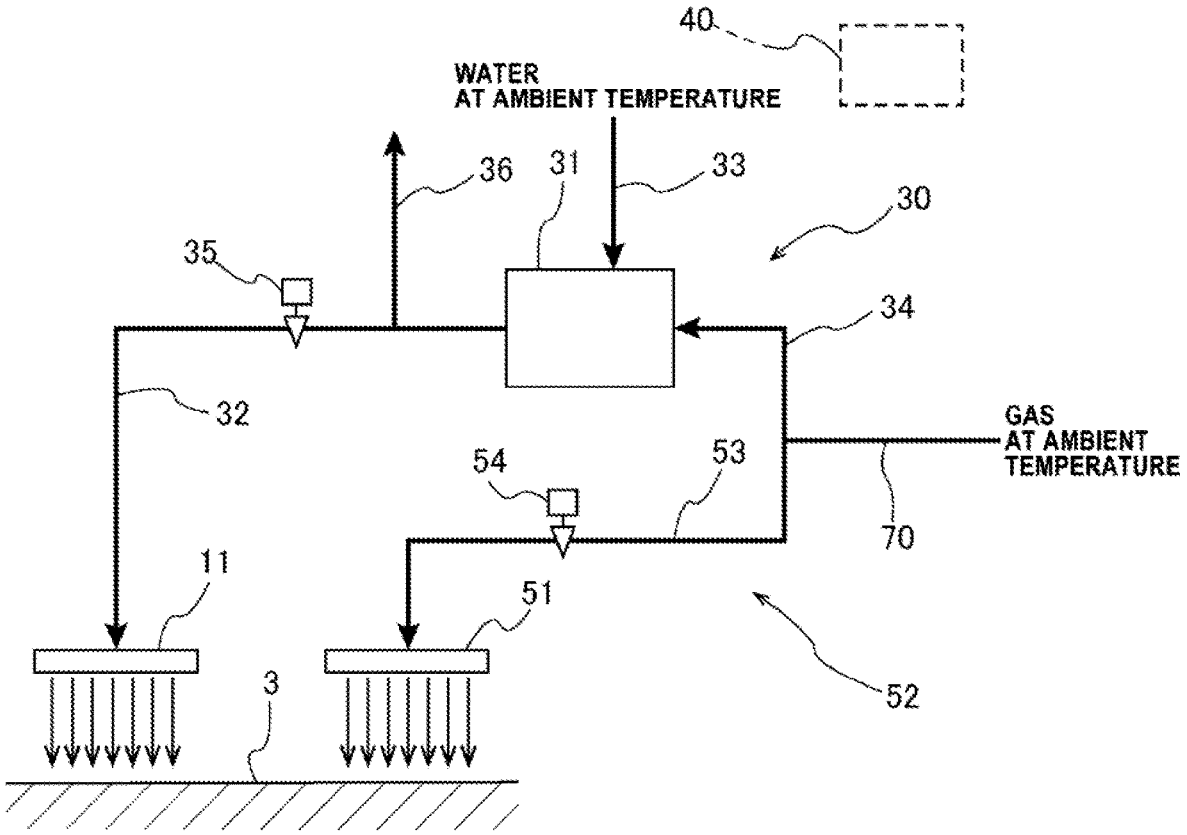
FIG. 2 is a schematic view showing a heating-fluid supply system and a cooling-fluid supply system according to an embodiment.

FIG. 2 is a schematic view showing a heating-fluid supply system and a cooling-fluid supply system according to an embodiment. The heating-fluid supply system 30 shown in FIG. 2 includes a superheated-steam generator (heating-fluid generator) 31, a superheated-steam supply line (heating-fluid supply line) 32 extending from the superheated-steam generator 31 to the heating-fluid nozzle 11, a water supply line 33 for supplying a water to the superheated-steam generator 31, a gas supply line 34 for supplying a gas at ambient temperature to the superheated-steam generator 31. The gas supply line 34 branches off from a gas main line 70 extending from a gas supply source (not shown), and extends to the superheated-steam generator 31.

The superheated-steam generator 31 mixes a water supplied from the water supply line 33 and a gas at ambient temperature supplied from the gas supply line 34 to generate the superheated steam regulated to a predetermined temperature. The superheated steam is supplied to the heating-fluid nozzle 11 through the superheated-steam supply line 32, and is ejected from the heating-fluid nozzle 11 onto the polishing surface of the polishing pad 3. This operation enables the temperature of the polishing surface of the polishing pad 3 to be increased.

The heating-fluid supply system 30 shown in FIG. 2 further includes a flow regulator (first flow regulator) 35 disposed in the superheated-steam supply line 32, and an exhaust line 36 which branches off from the superheated-steam supply line 32 at an upstream side of the flow regulator 35. Examples of the flow regulator 35 may include a mass flow controller, and a flow regulating valve. The flow regulator 35 enables a flow rate of the superheated steam supplied to the heating-fluid nozzles 11 to be controlled. Excess superheated steam is discharged from the polishing apparatus through the exhaust line 36.

In one embodiment, the heating-fluid supply system 30 may have an open/close valve (not shown), instead of the flow regulator 35. In this case, when the controller 40 instructs the open/close valve to be opened, the superheated steam (heating fluid) having a predetermined flow rate is supplied to the heating-fluid nozzle 11, and is ejected from the heating-fluid nozzle 11 onto the polishing surface of the polishing pad 3.

If a gas with high-temperature is used as the heating fluid instead of the superheated steam, the water supply line 33 is omitted in the heating-fluid supply system 30, and the superheated-steam generator 31 is replaced with a heating-gas heater. Further, the superheated-steam supply line 32 is replaced with a heating-gas supply line.

The cooling-fluid supply system 52 shown in FIG. 2 includes a cooling-gas supply line 53 branching off from the gas main line 70 and extending to the pad cooler 51, and a flow regulator (second flow regulator) 54 disposed in the cooling-gas supply line 53. Examples of the flow regulator 54 may include a mass flow controller, and a flow regulating valve. The flow regulator 54 enables a flow rate of the cooling gas supplied to the pad cooler 51 to be controlled. The cooling fluid is supplied to the pad cooler 51 through the cooling-gas supply line 53, and is ejected from the pad cooler 51 onto the polishing surface of the polishing pad 3. This operation enables the temperature of the polishing surface of the polishing pad 3 to be decreased.

In one embodiment, the cooling-fluid supply system 52 may have an open/close valve (not shown), instead of the flow regulator 54. In this case, when the controller 40 instructs the open/close valve to be opened, the cooling gas (cooling fluid) having a predetermined flow rate is supplied to the pad cooler 51, and is ejected from the pad cooler 51 onto the polishing surface of the polishing pad 3.

The controller 40 is coupled to the superheated steam generator 31, the flow regulators 35, 54, the vacuum source 63, and the flow regulator 64 (see FIG. 1). The controller 40 controls operation of at least one of the superheated steam generator 31, the flow regulators 35, 54, the vacuum source 63, and the flow regulator 64 based on the measurement value of the pad-temperature measuring device 10 to thereby match the pad surface temperature to the predetermined target temperature. For example, the controller 40 controls operations of the flow regulators 35, 54 to regulate the flow rate of the superheated steam and the flow rate of the cooling gas such that the pad surface temperature matches the predetermined target temperature.

The controller 40 may control at least one of operations of the superheated steam generator 31, the vacuum source 63, and the flow regulator 64, in addition to or instead of the operations of the flow regulators 35, 54. For example, the controller 40 may regulate a temperature of the superheated steam generated by the superheated steam generator 31, or may control operations of the vacuum source 63 and/or the flow regulator 64 to regulate an amount of air to be sucked. Changing the temperature of the superheated steam ejected onto the polishing surface of the polishing pad 3 enables the temperature of the polishing surface to be regulated. When the vacuum source 63 and/or the flow regulator 64 causes the amount of air to be sucked to be increased or decreased, an amount of vaporization heat lost from slurry on the polishing surface can be changed, thus enabling the temperature of the polishing surface to be regulated.

In one embodiment, operations of the vacuum source 63 and/or the flow regulator 64 of the suction mechanism 60 may be controlled to increase the amount of air to be sucked from the suction nozzle 61. With these operations, the suction mechanism 60 may be used as an auxiliary cooling mechanism for the cooling mechanism 50, or the cooling mechanism 50 may be omitted. Further, in one embodiment, the suction mechanism 60 may be omitted in the pad-temperature regulating apparatus 5. For example, if cooling of the pad surface temperature with the cooling mechanism 50 is sufficient, the suction mechanism 60 can be omitted.

The pad-temperature measuring device 10 (see FIG. 1) measures the pad surface temperature in a non-contact manner, and sends the measurement value to the controller 40. In this embodiment, the controller 40 performs PID control of an amount of operation in at least one of the superheated steam generator 31, the flow regulators 35, 54, the vacuum source 63, and the flow regulator 64 based on the pad surface temperature measured such that the pad surface temperature is maintained at the preset target temperature.

The method of regulating the temperature of the polishing surface of the polishing pad 3 with the controller 40 is not limited to PID control and any control method can be used, as long as the pad surface temperature measured can be maintained at the target temperature. For example, the controller 40 may have an AI (artificial intelligence) function that predicts or determines at least one of operation amounts of the superheated steam generator 31, the flow regulators 35, 54, the vacuum source 63, and the flow regulator 64 by using a learned model constructed by performing machine learning.

Figure 3A:
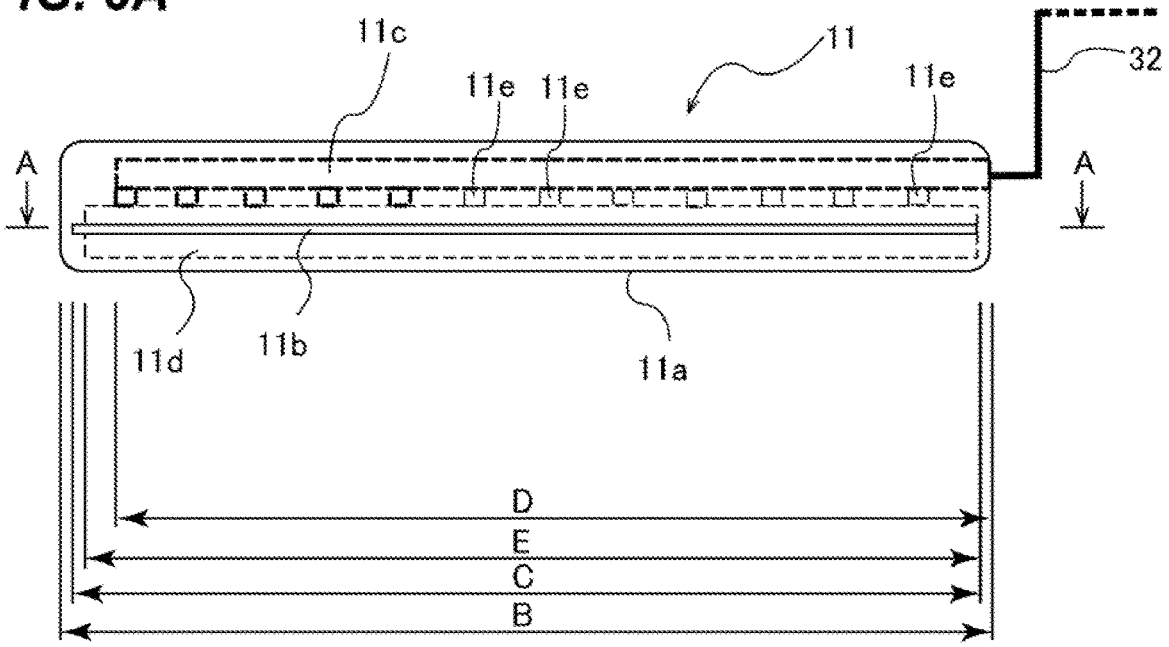
FIG. 3A is a bottom view of a heating-fluid nozzle according to an embodiment.
Figure 3B:
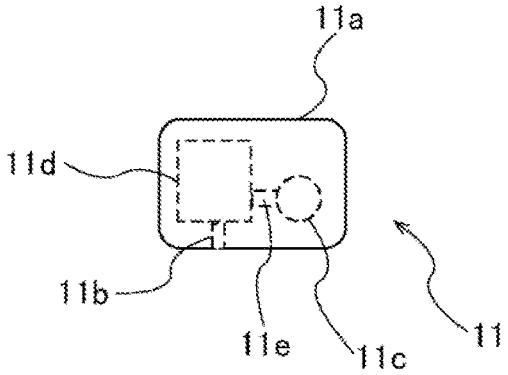
FIG. 3B is a transparent view of the heating-fluid nozzle shown in FIG. 3A viewing from a tip thereof.
Figure 3C:
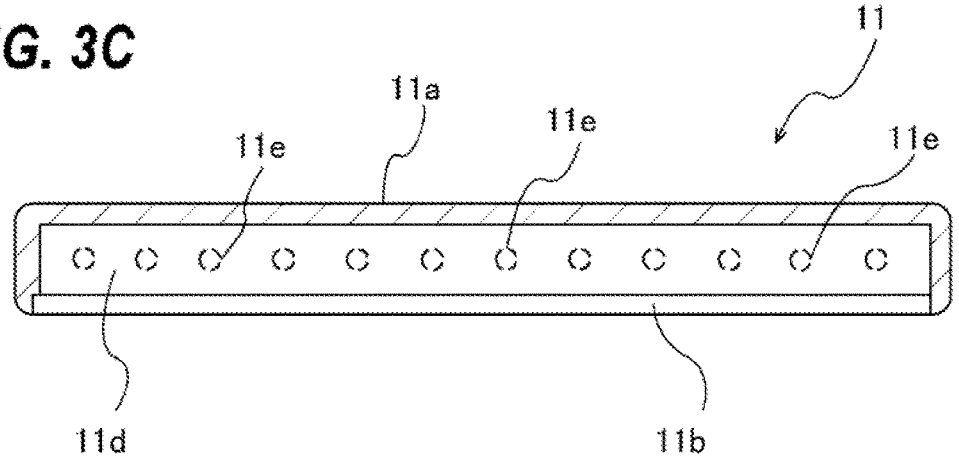
FIG. 3C is a cross-sectional view taken along line A-A shown in FIG. 3A.
Figure 4:
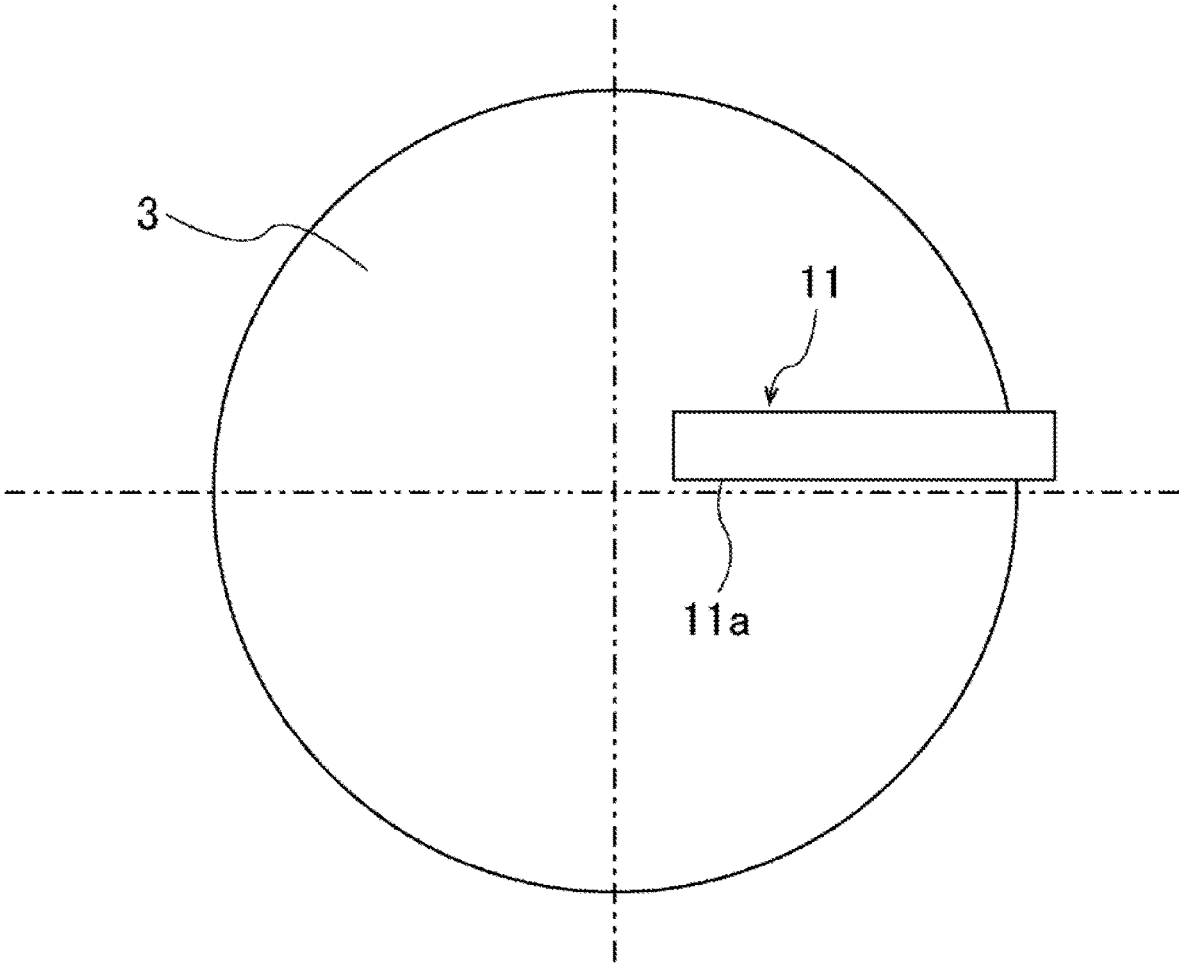
FIG. 4 is a top view showing an example of arrangement of the heating-fluid nozzles shown in FIGS. 3A through 3C with respect to the polishing pad.

FIG. 3A is a bottom view of a heating-fluid nozzle according to an embodiment, FIG. 3B is a transparent view of the heating-fluid nozzle shown in FIG. 3A viewing from a tip thereof, and FIG. 3C is a cross-sectional view taken along line A-A shown in FIG. 3A. FIG. 4 is a top view showing an example of arrangement of the heating-fluid nozzles shown in FIGS. 3A through 3C with respect to the polishing pad.

As shown in FIGS. 3A to 3C, the heating-fluid nozzle 11 has an elongate nozzle body 11*a*, and a slit 11*b* formed along a longitudinal direction of the nozzle body 11*a* for ejecting the heating fluid toward the polishing surface of the polishing pad 3. The slit 11*b* serves as an ejection opening for the heating fluid supplied to the nozzle body 11*a* from the superheated-steam supply line 32. In this embodiment, the nozzle body 11*a* extends in an approximate radial direction of the polishing pad 3 (see FIG. 4), and has a quadrangular prism shape. The slit 11*b* is formed in a lower surface of the nozzle body 11*a*, and extends in a straight line along the longitudinal direction of the nozzle body 11*a* for almost the entire length of the nozzle body 11*a*.

In this embodiment, the nozzle body 11*a* has quadrangular prism shape, but the shape of the nozzle body 11*a* is not limited to this example. For example, the nozzle body 11*a* may have a cylinder shape, or other polygonal prism shape, such as pentagonal prism shape, and hexagonal prism shape.

Further, in the illustrated embodiment, the slit 11*b* opens on a flat surface (bottom surface) of the nozzle body 11*a* having a quadrangular prism shape, but a location of the slit 11*b* opening in the nozzle body 11*a* can be freely selected. For example, the slit 11*b* may open at a corner of the nozzle body 11*a*, where adjacent flat surfaces are joined with each other. In the case also where the nozzle body 11*a* has polygonal prism shape other than quadrangular prism shape, the slit 11*b* may open on a flat surface of the nozzle body 11*a*, or may open at a corner.

Further, the heating-fluid nozzle 11 has a header tube 11*c*, a buffer tube 11*d*, and a plurality of (12 in the illustrated example) branch tubes 11*e* coupling the header tube 11*c* to the buffer tube 11*d*. The header tube 11*c*, the buffer tube 11*d*, and the plurality of branch tubes 11*e* are formed within the nozzle body 11*a*, respectively. In this embodiment, the header tube 11*c* and the buffer tube 11*d* extend along the longitudinal direction of the nozzle body 11*a* for almost the entire length of the nozzle body 11*a*.

The header tube 11*c* is coupled to the superheated-steam supply line 32, so that the superheated steam is supplied from the superheated-steam supply line 32 to the header tube 11*c* of the heating-fluid nozzle 11. In this embodiment, the superheated-steam supply line 32 is coupled to an end of the header tube 11*c*, but a location of the coupling of the superheated-steam supply line 32 to the header tube 11*c* may be freely selected, as long as the superheated steam can be supplied to the header tube 11*c* from the superheated-steam supply line 32.

The buffer tube 11*d* communicates with (is coupled to) the header tube 11*c* through the plurality of branch tubes 11*e*, and also communicates with the slit 11*b*. With this structure, the superheated steam supplied from the superheated-steam supply line 32 fills an inner space of the header tube 11*c*, and then flows into the buffer tube 11*d* through the plurality of branch tubes 11*e*. The superheated steam supplied to buffer tube 11*d* fills an inner space of the buffer tube 11*d*, and then is ejected from the slit 11*b* toward the polishing surface of the polishing pad 3.

In the embodiment shown in FIGS. 3A to 3C, the heating-fluid nozzle 11 has one slit 11*b*, but the number of heating-fluid nozzle 11 is not limited to this embodiment. The heating-fluid nozzle 11 may have a plurality of slits 11*b*.

Further, a length B of the nozzle body 11*a* in the longitudinal direction, and a length C (size in the longitudinal direction of the heating-fluid nozzle 11) of the slit 11*b* can be any lengths as long as the superheated steam can be applied to at least an entire area of the polishing pad 3 against which the wafer W is pressed. In other words, the length B of the nozzle body 11*a* in the longitudinal direction and the length C of the slit 11*b* are determined depending on a size (diameter) of the wafer W to be polished. In one embodiment, the length B of the nozzle body 11*a* in the longitudinal direction and the length C of the slit 11*b* may be determined depending on a size of the polishing pad 3. For example, the length B of the nozzle body 11*a* in the longitudinal direction and the length C of the slit 11*b* may be approximately equal to a radius of the polishing pad 3.

With this structure, the pressure distribution of superheated steam in the buffer tube 11*d* is made even, and further the flow guiding of superheated steam ejected from the slit 11*b* is improved. In other words, with a simple structure in which the header tube 11*c*, the buffer tube 11*d*, and the plurality of branch tubes 11*e* are provided in the heating fluid nozzle 11, an amount of superheated steam (heating fluid) ejected from the slit 11*b* can be made even along the radial direction of the polishing pad 3, thereby heating and maintaining the temperature distribution in the polishing surface of the polishing pad at the predetermined temperature distribution.

Structural conditions of the heating-fluid nozzle 11 set for ejecting the superheated steam from the slit 11*b* of the heating-fluid nozzle 11 (heating-fluid ejecting conditions) are preferably optimized in accordance with properties of the heating fluid to be ejected. The heating-fluid ejecting conditions include, for example, the length C and a width (size of slit 11*b* in a horizontal direction perpendicular to the longitudinal direction of the heating-fluid nozzle 11) of slit 11*b*, a length D of the header tube 11*c* (size in the longitudinal direction of the heating-fluid nozzle 11), a volume of the header tube 11*c*, a length E of the buffer tube 11*d* (size in the longitudinal direction of the heating fluid nozzle 11), a volume of the buffer tube 11*d*, the number of branch tubes 11*e*, a distance (pitch) between adjacent branch tubes 11*e*, and a cross-sectional area of each branch tube 11*e*. The properties of the superheated steam (heating fluid) for determining the heating-fluid ejecting conditions include, for example, a temperature and a pressure of the superheated steam supplied to the header tube 11*c*, and an amount of the superheated steam supplied to the header tube 11*c*.

The inventors, as a result of thoroughly researching, has found that a ratio of a volume of the buffer tube 11*d* to a sum of a volume of the header tube 11*c* and a volume of the branch tubes 11*e* among the heating-fluid ejecting conditions, has a significant effect on the evenness of the temperature distribution of the polishing pad in the radial direction. Specifically, the volume of buffer tube 11*d* is preferably 10 times or more than the sum of the volume of header tube 11*c* and the volume of branch tubes 11*e*, and is more preferably times or more than the sum of the volume of header tube 11*c* and the volume of branch tubes 11*e*.

In order to steadily eject the superheated steam with an uniform amount from the slit 11*b*, the header tube 11*c* has preferably a circular longitudinal cross-sectional shape, and the buffer tube 11*d* has preferably a rectangular longitudinal cross-sectional shape, as shown in FIG. 3B. The longitudinal cross-sectional shape refers to a shape as viewed in a cross-section extending in the vertical direction. However, the longitudinal cross-sectional shape of the header tube 11*c* and the longitudinal cross-sectional shape of the buffer tube 11*d* can be freely selected as long as the superheated steam with an uniform amount can be steadily ejected from the slit 11*b*. For example, if the volume of the buffer tube 11*d* is 10 times or more than the sum of the volume of the header tube 11*c* and the volume of the branch tubes 11*e*, the header tube 11*c* may have a square longitudinal cross-sectional shape, and the buffer tube 11*d* may have a circular longitudinal cross-sectional shape.

Further, the inventors have found that the smaller the width of slit 11*b*, the more advantageous it is for even temperature distribution in the radial direction of the polishing pad. For example, the width F of slit 11*b* is 1 mm or less.

Further, the length E of the buffer tube 11*d* is preferably approximately equal to the length D of the header tube 11*c*, more preferably 1% longer than the length D of the header tube 11*c*, and more preferably 1.2% longer than the length D of the buffer tube 11*c*.

Since the superheated steam ejected from the slit 11*b* of the heating-fluid nozzle 11 applies a condensation heat to the polishing liquid, a distance between a bottom surface of the nozzle body 11*a* of the heating-fluid nozzle 11 and the polishing pad 3 is preferably as small as possible. For example, the distance between the bottom surface of the nozzle body 11*a* of the heating-fluid nozzle 11 in which the slit 11*b* is formed and the polishing surface of the polishing pad 3 is preferably 4 mm or less, and more preferably 3 mm or less.

Further, the nozzle body 11*a* of the heating-fluid nozzle 11 is preferably made of a chemical-resistant and/or a heat-insulating material, or coated on its outer surface with this kind of material. Examples of the chemical-resistant and heat-insulating material may include polytetrafluoroethylene (PTFE), and polyetheretherketone (PEEK).

In the embodiment shown in FIGS. 3A to 3C, the slit 11*b* is formed only on the bottom surface of the nozzle body 11*a*. In one embodiment, the slit 11*b* may extend to an end surface of a tip of the nozzle body 11*a*.

Figure 5A:
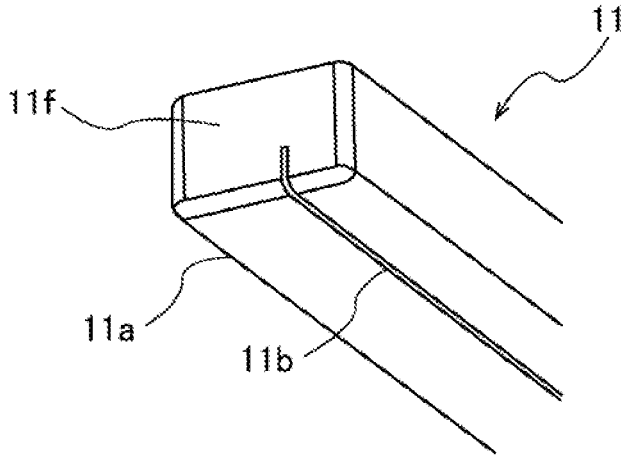
FIG. 5A is a perspective view schematically showing a tip of the heating-fluid nozzle according to another embodiment.
Figure 5B:
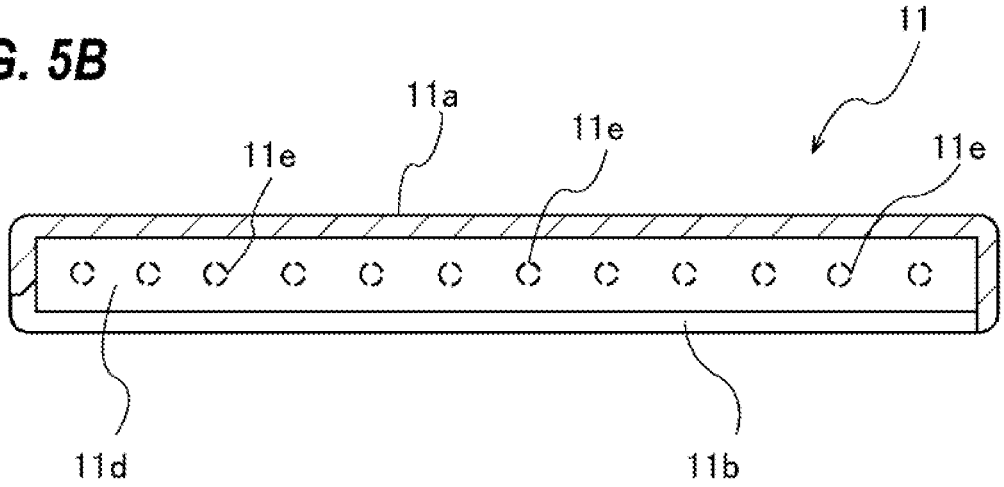
FIG. 5B is a cross-sectional view of the heating-fluid nozzle shown in FIG. 5A.

FIG. 5A is a perspective view schematically showing a tip of the heating-fluid nozzle according to another embodiment, and FIG. 5B is a cross-sectional view of the heating-fluid nozzle shown in FIG. 5A. Configurations of the present embodiment, which will not be described particularly, are the same as those of the embodiments described with reference to FIGS. 3A to 3B, and duplicate explanations will be omitted.

In this embodiment, the slit 11*b* of the heating-fluid nozzle 11 extends continuously from the bottom surface of the nozzle body 11*a* to the end surface 11*f* of the tip of the nozzle body 11*a*. Therefore, the superheated steam ejected from the slit 11*b* is directed toward a center of the polishing pad 3 farther than the tip of the nozzle body 11*a*. As described above, the superheated steam is blown at least to the entire area of the polishing pad 3 against which the wafer W is pressed. Using the slit 11*b* extending to the end surface 11*f* of the tip of the nozzle body 11*a* enables downsizing of the nozzle body 11*a* to be achieved.

Figure 6:
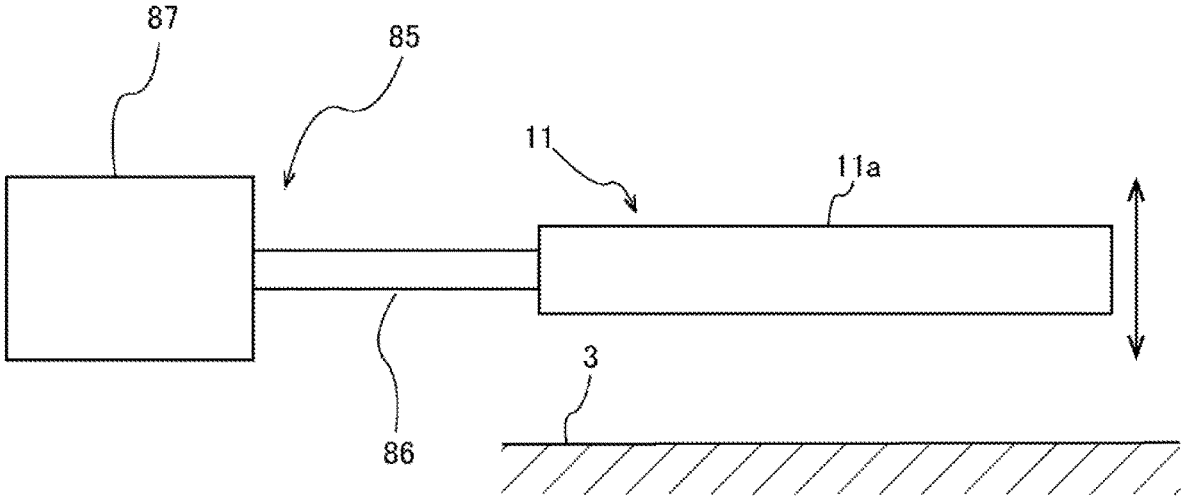
FIG. 6 is a schematic view showing an example of a vertical movement mechanism.

As shown in FIG. 6, the pad-temperature regulating apparatus 5 may include a vertical movement mechanism 85 for moving the heating-fluid nozzle 11 up and down with respect to the polishing surface of the polishing pad 3. FIG. 6 is a schematic view showing an example of the vertical movement mechanism. In the heating-fluid nozzle 11 shown in FIG. 6, no structures other than the nozzle body 11*a* are omitted from the illustration.

The vertical movement mechanism 85 shown in FIG. 6 includes a support arm 86 coupled to the heating-fluid nozzle 11, and a vertical movement actuator 87 for moving the heating-fluid nozzle 11 up and down through the support arm 86. In this embodiment, the support arm 86 is coupled to the nozzle body 11*a* of the heating-fluid nozzle 11. Configuration of the vertical movement actuator 87 can be freely selected as long as the heating-fluid nozzle 11 can be moved in the vertical direction. For example, the vertical movement actuator 87 may be a piston cylinder assembly having a piston for moving the heating-fluid nozzle 11 up and down through the support arm 86, or may be a motor (e.g., a servo motor or a stepping motor) for moving the heating-fluid nozzle 11 up and down through the support arm 86. In one embodiment, the vertical movement actuator 87 may be a piezo actuator that uses piezoelectric effect of piezoelectric element to move the heating-fluid nozzle 11 up and down through the support arm 86.

The vertical movement mechanism 85 is coupled to the controller 40 (see FIG. 1). The controller 40 controls operation of the vertical movement mechanism 85 (i.e., an operation amount of the vertical movement actuator 87) based on the measurement value of the pad-temperature measuring device 10, thereby changing a position of the heating-fluid nozzle 11 in the vertical direction with respect to the polishing surface of the polishing pad 3. When a distance between the heating-fluid nozzle 11 and the polishing pad 3 is changed, the temperature of the superheated steam which comes into collision with the polishing surface of the polishing pad 3 is changed. For example, when the heating-fluid nozzle 11 is moved closer to the polishing pad 3, the superheated steam with a higher temperature comes into collision with the polishing surface of the pad 3, thereby increasing the pad surface temperature. In contrast, when the heating-fluid nozzle 11 is moved away from the polishing pad 3, the superheated steam with a lower temperature comes into collision with the polishing surface of the polishing pad 3, thereby decreasing the pad surface temperature. Therefore, changing the distance between the heating-fluid nozzle 11 and the polishing surface of the polishing pad 3 enables the pad surface temperature to be regulated.

Figure 7A:
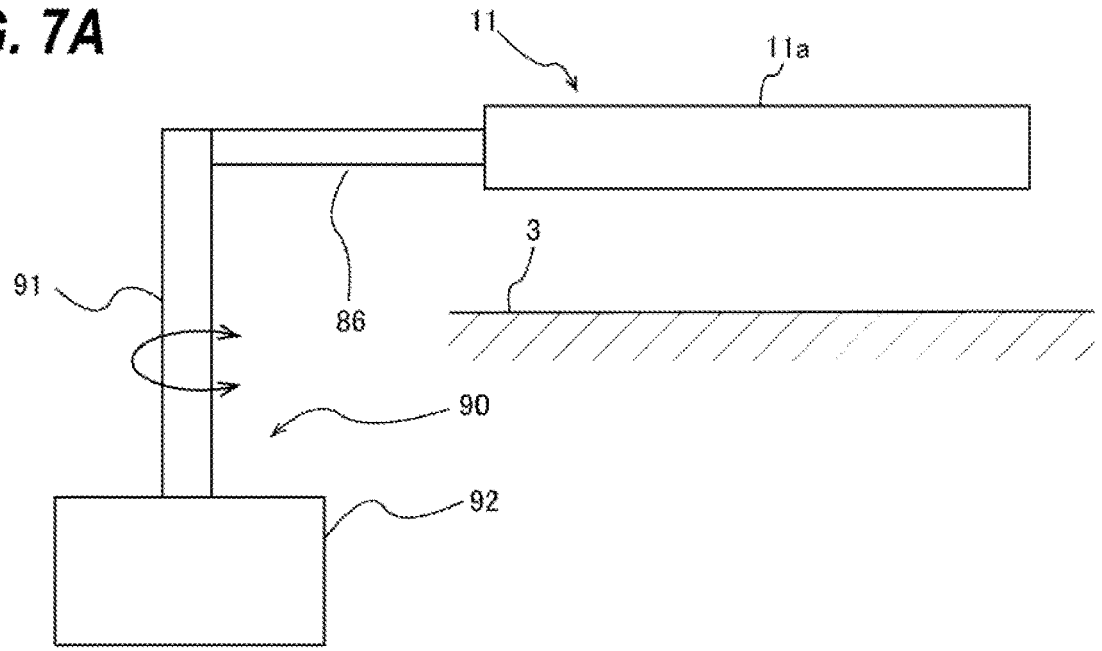
FIG. 7A is a schematic view showing an example of a pivoting mechanism.
Figure 7B:
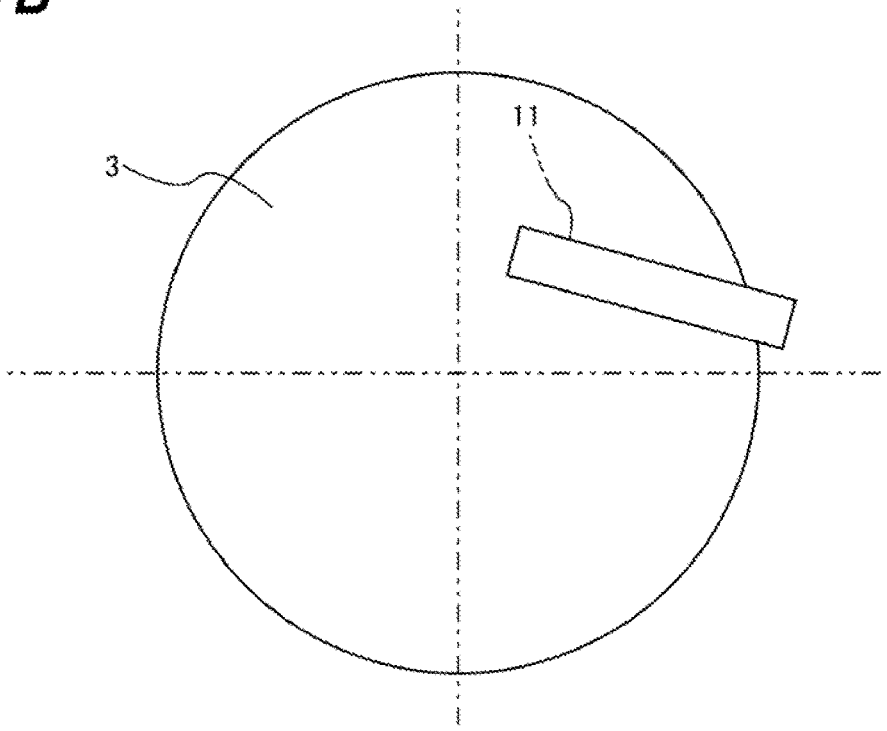
FIG. 7B is a top view showing the heating-fluid nozzle pivoted by the pivoting mechanism.

Further, as shown in FIG. 7A, the pad-temperature regulating apparatus 5 may include a pivoting mechanism 90 for pivoting the heating-fluid nozzle 11 in a horizontal direction with respect to the polishing surface of the polishing pad 3. FIG. 7A is a schematic view showing an example of the pivoting mechanism, and FIG. 7B is a top view showing the heating-fluid nozzle pivoted by the pivoting mechanism. In the heating-fluid nozzle 11 shown in FIGS. 7A and 7B, no structures other than the nozzle body 11*a* are omitted from the illustration.

The pivoting mechanism 90 shown in FIG. 7A includes a pivot shaft 91 coupled to the heating-fluid nozzle 11 through the support arm 86, and a pivoting actuator 92 for pivoting the pivot shaft 91. The pivoting actuator 92 is, for example, a motor (e.g., a servo motor or a stepping motor), or a rotary cylinder which pivots the pivot shaft 91. In one embodiment, the pivoting actuator 92 may be a piston cylinder with a piston. In this case, the pivoting mechanism 90 has a link mechanism to convert a movement of the piston of the piston cylinder into a pivoting movement of the pivot shaft 91.

The pivoting mechanism 90 is coupled to a controller 40 (see FIG. 1). The controller 40 controls operation of the pivoting mechanism 90 (i.e., an operation amount of the pivoting actuator 92) based on the measurement value of the pad-temperature measuring device 10, thereby controlling a pivoting angle of the heating-fluid nozzle 11 with respect to the polishing surface of the polishing pad 3.

As shown in FIG. 7B, when the heating-fluid nozzle 11 is pivoted from an initial position (see FIG. 4) where the nozzle body 11*a* of the heating-fluid nozzle 11 extends approximately parallel to the radial direction of the polishing pad 3, a direction and an amount of superheated steam which comes into collision with the polishing surface of the polishing pad 3 are changed. Consequently, controlling the pivoting angle of the heating-fluid nozzle 11 from the initial position enables the pad surface temperature to be regulated.

Figure 8A:
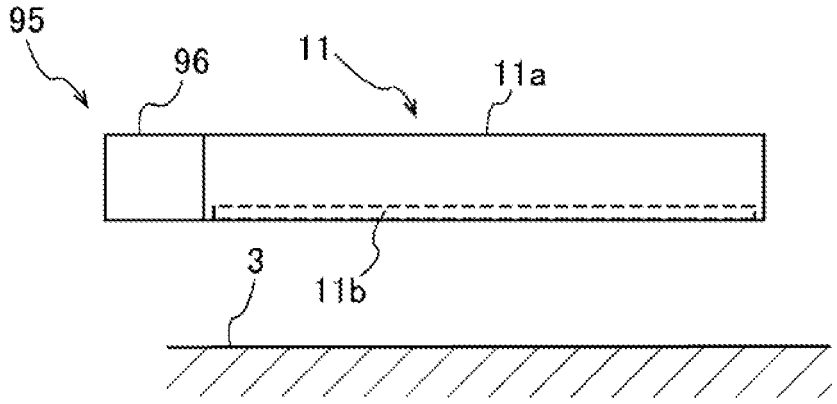
FIG. 8A is a schematic view showing an example of a rotation mechanism for rotating the heating-fluid nozzle around a longitudinal axis thereof.
Figure 8B:
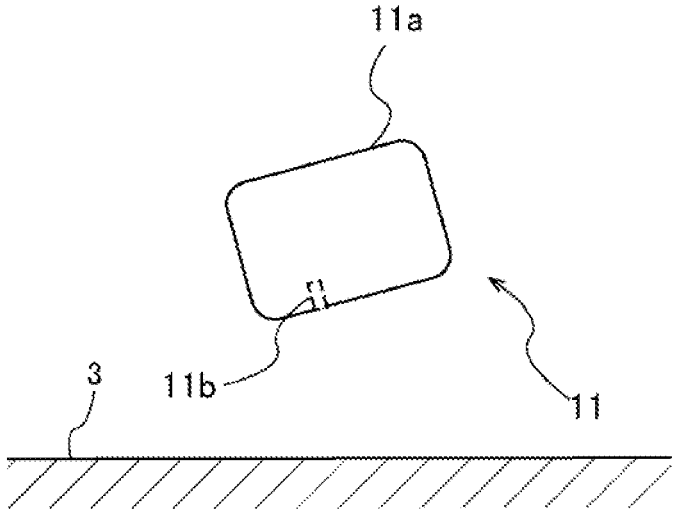
FIG. 8B is a schematic view showing a state where the heating-fluid nozzle shown in FIG. 8A is rotated, as viewed from the tip of the heating-fluid nozzle.

FIG. 8A is a schematic view showing an example of a rotation mechanism for rotating the heating-fluid nozzle around a longitudinal axis thereof, and FIG. 8B is a schematic view showing a state where the heating-fluid nozzle shown in FIG. 8A is rotated, as viewed from the tip of the heating-fluid nozzle. In the heating-fluid nozzle 11 shown in FIGS. 8A and 8B, no structures other than the nozzle body 11*a* are omitted from the illustration.

The rotation mechanism 95 shown in FIG. 8A is composed of a rotary actuator 96 which is attached to the end of the heating-fluid nozzle 11 and rotates the heating-fluid nozzle 11. The rotary actuator 96 is, for example, a servo motor or a stepping motor.

The rotation mechanism 95 is coupled to a controller 40 (see FIG. 1). The controller 40 controls operation of the rotation mechanism 95 (i.e., an operation amount of the rotary actuator 96) based on the measurement value of the pad-temperature measuring device 10, thereby changing an orientation of the slit 11*b* of the heating-fluid nozzle 11 with respect to the polishing surface of the polishing pad 3.

As shown in FIG. 8B, when the orientation of the slit 11*b* of the heating-fluid nozzle 11 with respect to the polishing surface of the polishing pad 3 is changed, the amount and the temperature of the superheated steam which comes into collision with the polishing surface of the polishing pad 3 are changed. More specifically, when the heating-fluid nozzle 11 is rotated, the amount and the temperature of the superheated steam which comes into collision with the polishing surface of the polishing pad 3 decreases, thereby decreasing the pad surface temperature. Therefore, controlling the rotation angle of the heating-fluid nozzle 11 with respect to the support arm 86 enables the pad surface temperature to be regulated.

The pad-temperature regulating apparatus 5 may have a combination of any two of the vertical movement mechanism 85, the pivoting mechanism 90, and the rotation mechanism 95 described above, or may have all of the vertical movement mechanism 85, the pivoting mechanism 90, and the rotation mechanism 95 described above.

Figure 9A:
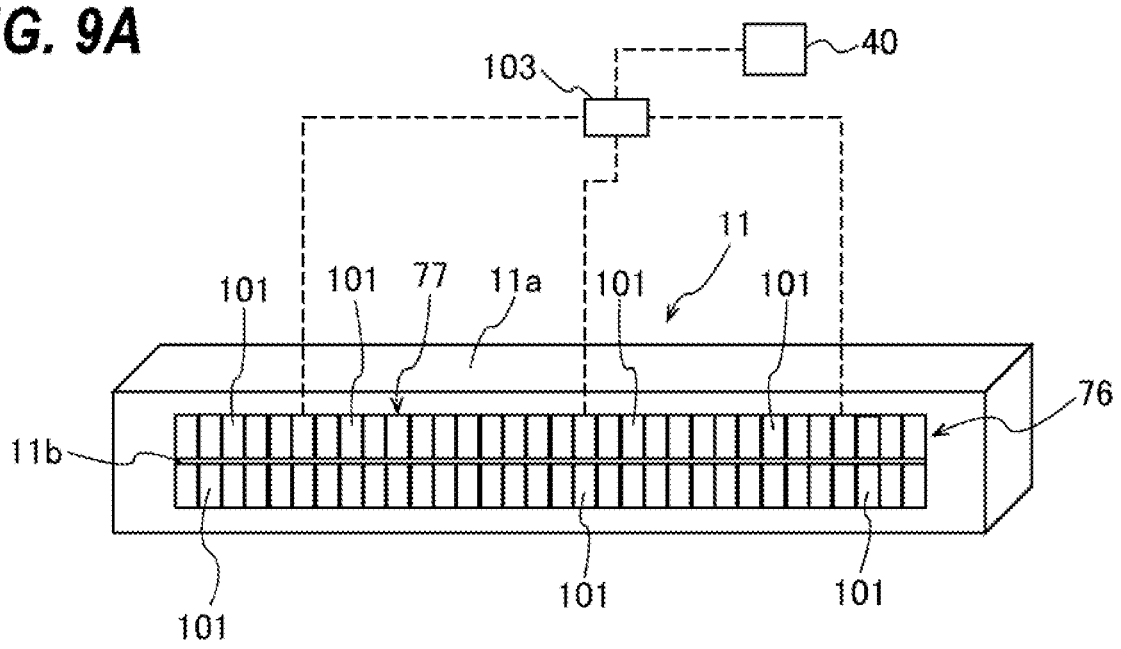
FIG. 9A is a perspective view of the heating-fluid nozzle according to yet another embodiment as viewed from a bottom side.
Figure 9B:
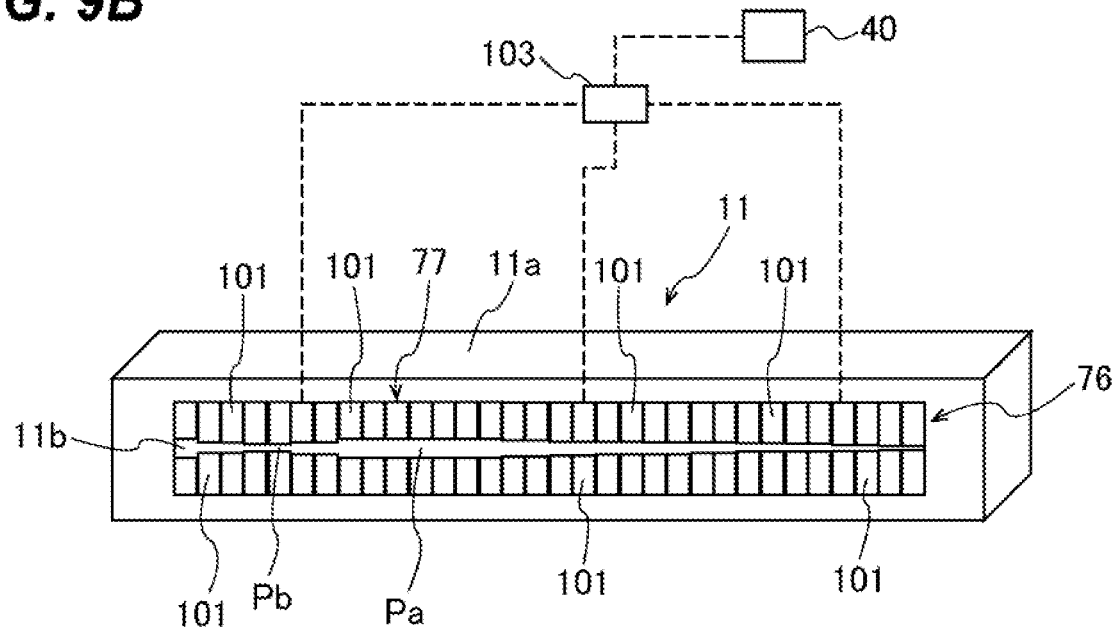
FIG. 9B is a schematic view showing an example of operation of the heating-fluid nozzle shown in FIG. 9A.

FIGS. 9A and 9B are schematic views showing the heating-fluid nozzles according to yet another embodiment. More specifically, FIG. 9A is a perspective view of the heating-fluid nozzle according to yet another embodiment as viewed from a bottom side, and FIG. 9B is a schematic view showing an example of operation of the heating-fluid nozzle shown in FIG. 9A. Configurations of the present embodiment, which will not be described particularly, are the same as those of the embodiments described above, and duplicate explanations will be omitted.

The heating-fluid nozzle 11 shown in FIG. 9A further has a shutter mechanism 76 including a shutter 77 for regulating a width of the slit 11*b* (degree of opening of the slit 11*b*). The shutter 77 is composed of a plurality of piezo-elements 101. The plurality of piezo-elements 101 are arranged along a longitudinal direction of the slit 11*b* (i.e., along the longitudinal direction of the nozzle body 11*a*). The shutter 77 shown in FIG. 9A regulates the degree of opening of the slit 11*b* by the expansion and contraction action of each of the piezo-elements 101 due to the inverse piezoelectric effect.

Each piezo-element 101 is coupled to the piezo-element driver 103, and the piezo-element driver 103 is coupled to the controller 40 (see FIG. 1). In FIG. 9A, only the control lines extending from some piezo-elements 101 to the piezo-element driver 103 are illustrated in order to prevent complicated illustrations. The controller 40 can control operation of the piezo-element driver 103 to independently control the expansion and contraction operations of each piezo-element 101 (see FIG. 9B, for example). The piezo-element driver 103 serves as an actuator for regulating the degree of opening of the slit 11*b* in the heating-fluid nozzle 11.

Figure 10:
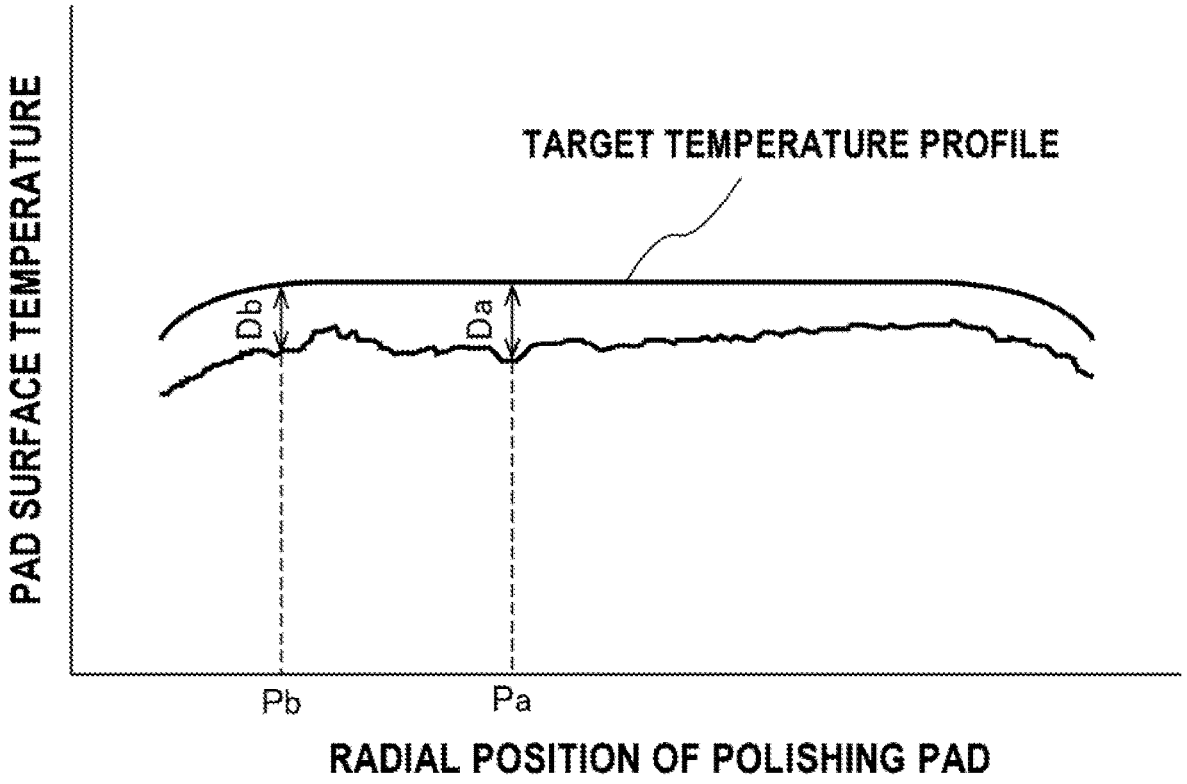
FIG. 10 is a graph showing an example of a combination of a target temperature profile of the polishing pad and a temperature profile acquired by a pad-temperature measuring device.

When the pad-temperature measuring device 10 is the temperature distribution measuring device described above, the controller 40 can acquire the temperature distribution (temperature profile) of the polishing pad 3 along the radial direction of the polishing pad 3. FIG. 10 is a graph showing an example of a combination of the target temperature profile of the polishing pad and the temperature profile acquired by the pad-temperature measuring device. In FIG. 10, the vertical axis represents the pad surface temperature, and the horizontal axis represents the radial position of the polishing pad.

For precise control of the in-plane evenness (flatness) of the surface of the wafer W in its entirety after polishing, it is preferable to constantly match the temperature profile to the target temperature. Therefore, in this embodiment, the controller 40 controls the expansion and contraction operations of each piezo-element 101 such that the temperature profile acquired by the pad-temperature measuring device 10 matches the target temperature. For example, as shown in FIG. 10, the controller 40 causes the piezo-elements 101 corresponding to a position Pa of the polishing pad 3, where a difference Da between the target temperature and the measured temperature is larger, to contract greatly and increase an amount of superheated steam to be ejected. On the other hand, the controller 40 causes the amount of expansion and contraction of the piezo-elements 101 corresponding to position Pb of the polishing pad 3, where a difference Db between the target temperature and the measured temperature is smaller, to be decreased, so that the amount of superheated steam to be ejected is decreased compared to the amount of superheated steam to be ejected at position Pa.

The controller 40 controls operation of the piezo-element driver 103 (i.e., amounts of expansion and contraction of each piezo-element 101) based on the measurement value of the pad-temperature measuring device 10, thereby freely regulating the degree of opening of the slit 11*b* along the radial direction of the polishing pad 3. When the degree of opening of the slit 11*b* is changed, a flow velocity and a temperature of the superheated steam, which comes into collision with the polishing surface of the polishing pad 3, change, and thus the temperature of the pad surface is changed. Performing such pad temperature control enables the temperature profile of the polishing pad 3 in its entirety to be more precisely matched to the target temperature. As a result, the wafer W can be precisely polished.

Figure 11:
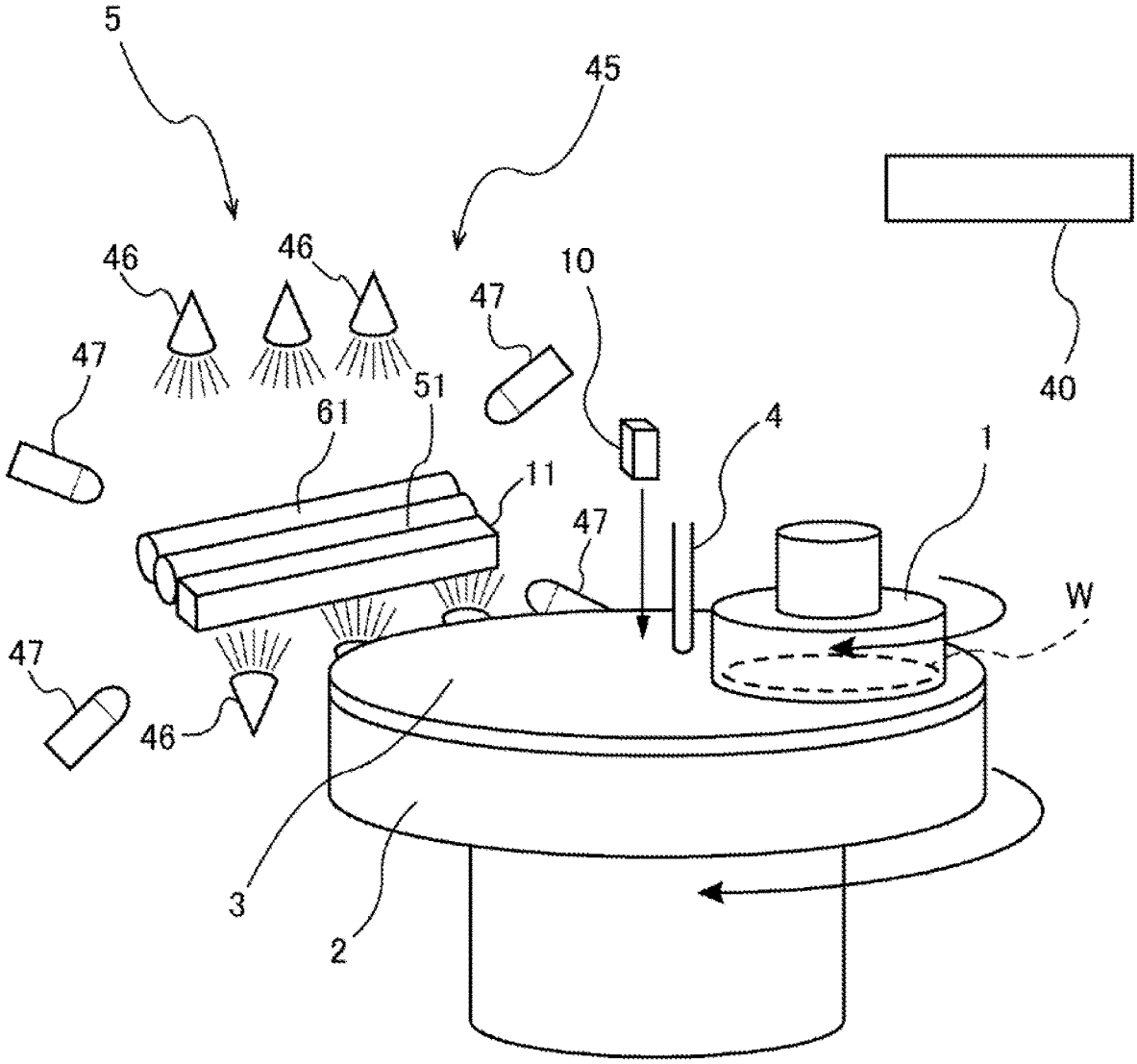
FIG. 11 is a schematic view showing the polishing apparatus with the pad-temperature regulating apparatus according to another embodiment.

FIG. 11 is a schematic view showing the polishing apparatus with the pad-temperature regulating apparatus according to another embodiment. Configurations of the present embodiment, which will not be described particularly, are the same as those of the embodiments described above, and duplicate explanations will be omitted.

The pad-temperature regulating apparatus 5 shown in FIG. 11 includes a cleaning apparatus 45 for cleaning the heating-fluid nozzle 11, the pad cooler 51, and the suction nozzle 61 at a retreat-position located laterally to the polishing pad 3. The controller 40 is coupled to the cleaning apparatus 45 to control operation of the cleaning apparatus 45. In the pad-temperature regulating apparatus shown in FIG. 11, only the heating fluid nozzle 11, the pad cooler 51, the suction nozzle 61, and the cleaning device 45 are illustrated, and the other components of the pad-temperature regulating apparatus 5 are omitted from the illustration.

In this embodiment, the pad-temperature regulating apparatus 5 includes the pivoting mechanism 90 described above, and the controller 40 causes the pivoting actuator 92 (see FIG. 7A) of the pivoting mechanism 90 to be operated, thereby moving the heating-fluid nozzle 11, the pad cooler 51, and the suction nozzle 61 from their initial position located above the polishing pad 3 (see FIG. 1) to the retreat-position shown in FIG. 11.

The cleaning apparatus 45 includes a plurality of sprays 46 for spraying a cleaning liquid (e.g., pure water) from above and below onto the heating-fluid nozzles 11, the pad cooler 51, and the suction nozzles 61, which have been moved to the retreat-position. The controller 40 causes the cleaning liquid to be sprayed from the sprays 46 onto the heating fluid nozzle 11, the pad cooler 51, and the suction nozzles 61, after the heating fluid nozzle 11, the pad cooler 51, and the suction nozzle 61 have moved to the retreat-position. This operation enables dirt attached to the heating-fluid nozzle 11, the pad cooler 51, and the suction nozzle 61 to be cleaned. In particular, the cleaning liquid can removes dirt that has entered into the slit 11*b* of the heating-fluid nozzle 11. As a result, the heating-fluid nozzle 11 can eject the superheated steam with a stable and uniform amount from its slit 11*b*.

After the cleaning of the heating fluid nozzle 11, the pad cooler 51, and the suction nozzle 61 is completed, the controller 40 controls operation of the pivoting mechanism 90 to move the heating-fluid nozzle 11, the pad cooler 51, and the suction nozzle 61 to their initial position. If droplets of cleaning liquid fall from the heating-fluid nozzle 11, the pad cooler 51, and the suction nozzle 61, which have moved to the initial position, onto the polishing pad 3, concentration of the polishing liquid (slurry) may change, resulting in adversely affecting the polishing performance. Therefore, in this embodiment, the cleaning apparatus 45 may have a plurality of nozzles 47 for spraying a gas (e.g., air, nitrogen, or argon) onto the heating-fluid nozzle 11, the pad cooler 51, and the suction nozzle 61 after cleaning with the cleaning liquid.

The gas blown from the nozzles 47 can blow off the cleaning liquid adhering to the heating-fluid nozzle 11, the pad cooler 51, and the suction nozzle 61, thereby drying the heating-fluid nozzle 11, the pad cooler 51, and the suction nozzle 61. This drying process prevents the droplets of cleaning liquid from falling onto the polishing pad 3 from the heating-fluid nozzle 11, the pad cooler 51, and the suction nozzle 61 which have been moved to their initial position. In one embodiment, the sprays 46 may have a function of spraying a gas separately from the cleaning liquid onto the heating-fluid nozzle 11, the pad cooler 51, and the suction nozzle 61.

In the embodiment described above, the pad-temperature regulating apparatus 5 has not only the heating mechanism 9 including the heating-fluid nozzle 11, but also the cooling mechanism 50 and the suction mechanism 60. However, in the pad-temperature regulating apparatus 5, either or both of the cooling mechanism 50 and the suction mechanism 60 may be omitted. In the case where either or both of the cooling mechanism 50 and the suction mechanism 60 are omitted, the pad-temperature regulating apparatus 5 preferably has at least one of the vertical movement mechanism 85, the pivoting mechanism 90, and the rotation mechanism 95 described above. These mechanisms 85, 90, and 95 enable the pad surface temperature to be precisely regulated.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus for polishing a substrate by pressing the substrate held by a polishing head against a polishing surface of a polishing pad supported by a polishing table, comprising:

a pad-temperature regulating apparatus configured to regulate a temperature of the polishing surface based on a measurement value of a pad-temperature measuring device for measuring the temperature of the polishing surface, wherein the pad-temperature regulating apparatus includes a heating-fluid nozzle arranged above and spaced apart from the polishing surface;

wherein the heating-fluid nozzle includes:

an elongate nozzle body;

at least one slit formed along a longitudinal direction of the nozzle body for ejecting a heating fluid toward the polishing surface;

a header tube which is formed within the nozzle body and into which the heating fluid is supplied;

a buffer tube which is formed within the nozzle body and communicates with the at least one slit, and a plurality of branch tubes for coupling the header tube to the buffer tube, wherein a volume of the buffer tube is 10 times or more than a sum of a volume of the header tube and a volume of the branch tubes, and wherein a first flow direction of the heating fluid through the branch pipe and a second flow direction of the heating fluid through the at least one slit are substantially perpendicular to each other.

2. The polishing apparatus according to claim 1, wherein the at least one slit extends to an end surface of a tip of the nozzle body.

3. The polishing apparatus according to claim 1, wherein the buffer tube and the header tube extend along the longitudinal direction of the nozzle body.

4. The polishing apparatus according to claim 1, wherein the nozzle body extends in an approximate radial direction of the polishing pad.

5. The polishing apparatus according to claim 1, wherein the nozzle body is made of or coated with a material having chemical resistance and/or heat insulation.

6. The polishing apparatus according to claim 1, further comprising a cleaning apparatus configured to clean the heating-fluid nozzle at a retreat-position located laterally to the polishing pad.

7. A polishing apparatus for polishing a substrate by pressing the substrate held by a polishing head against a polishing surface of a polishing pad supported by a polishing table, comprising:

a pad-temperature regulating apparatus configured to regulate a temperature of the polishing surface, wherein the pad-temperature regulating apparatus includes a heating-fluid nozzle arranged above and spaced apart from the polishing surface;

wherein the heating-fluid nozzle includes:

an elongate nozzle body;

at least one slit formed along a longitudinal direction of the nozzle body for ejecting a heating fluid toward the polishing surface;

a header tube which is formed within the nozzle body and into which the heating fluid is supplied;

a buffer tube which is formed within the nozzle body and communicates with the at least one slit, and a plurality of branch tubes for coupling the header tube to the buffer tube, wherein a first flow direction of the heating fluid through the branch pipe and a second flow direction of the heating fluid through the at least one slit are substantially perpendicular to each other.

8. The polishing apparatus according to claim 7, wherein a volume of the buffer tube is 10 times or more than a sum of a volume of the header tube and a volume of the branch tubes.

* * * * *